United States Patent [19]

Fraser

[11] 4,000,944

[45] Jan. 4, 1977

[54] PHOTORECEPTOR FOR ELECTROSTATIC REPRODUCTION MACHINES WITH BUILT-IN ELECTRODE

[75] Inventor: Lawrence J. Fraser, Rochester, N.Y.

[73] Assignee: Xerox Corporation, Stamford, Conn.

[22] Filed: Feb. 18, 1975

[21] Appl. No.: 550,301

[52] U.S. Cl. ..... 355/14; 96/1 R; 324/72; 355/3 R

[51] Int. Cl.[2] ..... G03G 15/00

[58] Field of Search ..... 355/3 R, 3 DR, 14, 3 CH, 355/133; 96/1 R, 1.5; 317/262 A; 324/72; 428/906, 913

[56] References Cited

UNITED STATES PATENTS

| | | | |
|---|---|---|---|
| 3,056,136 | 9/1962 | Macgriff | 355/14 X |
| 3,426,354 | 2/1969 | Gundlach | 96/1 R UX |
| 3,677,148 | 7/1972 | Chen | 355/3 R X |
| 3,788,739 | 1/1974 | Coriale | 355/3 R X |
| 3,924,462 | 12/1975 | Bock | 96/1 R X |

*Primary Examiner*—Fred L. Braun

[57] ABSTRACT

An electrostatic type copying or reproduction machine incorporating, as an integral, part of the machine photoconductive member, a signal generating electrode for use in controlling one or more of the machine processing parameters.

10 Claims, 10 Drawing Figures

PHOTORECEPTOR FOR ELECTROSTATIC REPRODUCTION MACHINES WITH BUILT-IN ELECTRODE

This invention relates to electrostatic type reproduction or copying apparatus, and more particularly to an improved photoreceptor for use with such apparatus.

In electrostatic type copying or reproduction machines, the machine photoconductive or photosensitive member is first brought to a uniform charge, normally by the use of a corona generator. Following charging, the member is exposed to the original being copied, normally by means of light. This produces selective discharge of the area of the photoconductive member exposed in conformance with the original being copied to produce a latent electrostatic image. This image is then developed, and, in the case of transfer xerography, transferred to a copy substrate material such as paper. The transferred image is then fused or fixed.

In carrying out the aforedescribed operations, variations in system process parameters, for example, the ability of the photoconductive member to accept the charge, sometimes occur with use and age. One way to accommodate at least some of these process variations, is to re-adjust the working levels of one or more of the process operating components, for example, the charging level of the corona generator, or the bias applied to the machine developers, etc. Adjustments of these types can be effected manually from time to time, or in an automatic or continuous manner as machine conditions change.

One manner in which continual adjustment of one or more of the process components i.e. the corona generator, may be effected is by the use of an automatic electrometer. For example, the charge level of the photoconductive member before exposure may be monitored, either continuously or from time to time by the electrometer. The electrometer output, which reflects changes in the charge level on the surface of the member, is then used to adjust the voltage input to the corona emissions element of a conventional corona generator. This in turn varies the effective operating charge of the photoconductive member.

One prior art electrometer system mechanically vibrates the electrometer probe at a uniform rate. This produces a sinusoidal signal output reflecting the electrostatic charge level on the area of the photoconductive surface being measured. The signal output as aforesaid is processed by the electrometer which may provide a visual reading of the charge on a meter. Alternatively, where an automatic control system, is provided, the probe signal is used to regulate one or more of the machine processing components i.e. the corona generator, to provide and maintain the desired operating charge level on the photoconductive surface.

In controlling machine process parameters affecting the photoconductive member, such as alluded to above, it is necessary to read or monitor the condition of the photoconductive member. This normally requires some type of device, which may be termed a probe, for viewing or scanning the surface of the photoconductive member and, as a result of that viewing or scanning, producing a signal reflecting the condition of the member. In the case of the electrometer system described above, the probe therefore comprises a relatively complex, expensive, and fragile mechanism.

It is therefore a principal object of the present invention to provide a new and improved photoconductive member for use in electrostatic type copiers and duplicators.

It is a further object of the present invention to provide an improved photoreceptor incorporating an integral control electrode.

It is an object of the present invention to provide a photoreceptor for use with electrostatic copying machines having an electrode for use in controlling one or more of the machine processing parameters integral therewith.

It is an object of the present invention to provide an improved machine condition responsive electrode for electrostatic copying or reproduction machines adapted to produce a sinusoidal signal pattern reflecting the electrostatic condition of the machine photosensitive member.

It is an object of the present invention to provide an improved low cost electrostatic machine condition signal generator adapted for use as the probe element of an electrometer.

This invention relates to a photoreceptor for use with electrostatic type reproduction machines comprising, a substrate; and a coating of photoconductive material on one surface of the substrate, portions of the photoconductive coated surface of the substrate being interrupted at regular intervals by conductive areas, the conductive areas extending in strip-like progression along the substrate coated surface in the direction of movement of the photoreceptor when in a reproduction machine whereby to provide a built-in striplike control electrode with the photoreceptor.

Other objects and advantages will be apparent from the ensuing description and drawings in which.

Figure 1:
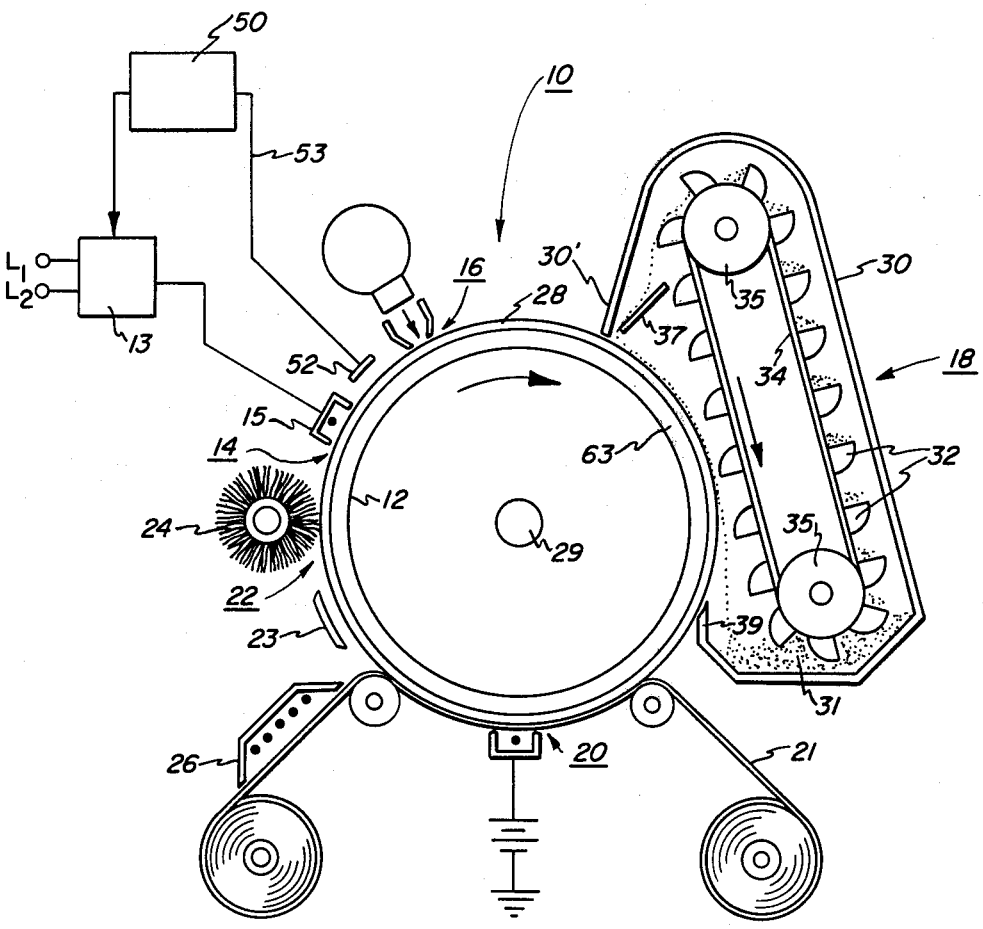
FIG. 1 is a schematic showing of an exemplary xerographic machine of the type adapted to incorporate the present invention.

Referring to FIG. 1 of the drawings, there is shown an exemplary xerographic machine, designated generally by the numeral 10, embodying the principles of the present invention. Referring thereto, a series of processing stations are provided about the periphery of xerograpic drum 12 as follows:

A charging station 14, at which a uniform electrostatic charge is deposited on the photoconductive layer of the xerographic drum 12 by a suitable corona generating means, such as corotron 15. A suitable power supply 13 is provided for operating corotron 15;

An exposure station 16, at which the light or radiation pattern of copy to be reproduced is projected onto the photoconductive surface of drum 12 to selectively dissipate, in accordance with the copy image pattern, the charge on the drum surface to thereby form a latent electrostatic image of the copy to be reproduced;

A development station 18, at which a xerographic developing material including toner powder having an electrostatic charge opposite to that of the latent electrostatic image on the photoconductive surface of drum 12 is brought into contact with the drum surface, the toner powder adhering to the latent electrostatic image to form a xerographic powdered image in the configuration of the copy being reproduced.

A transfer station 20, at which the xerographic powdered image is electrostatically transferred from the drum surface to a suitable support surface such as web 21; and A drum cleaning station 22 at which the surface of drum 12 is brushed to remove residual toner particles remaining thereon after image transfer. To facilitate cleaning of drum 12, a fadeout or exposure lamp 23 may be provided to discharge any residual charges on the drum photoconductive surface in preparation for cleaning by a suitable brush 24.

A suitable fixing device or fuser 26 is provided to permanently fix the toner image on web 21.

The aforesaid stations are operatively disposed about the xerograpic surface of drum 12 upon which the images are to be formed. The photoconductive or xerographic surface of drum 12 designated here by the numeral 28 may comprise any suitable photoconductive or photosensitive material such as selenium. Shaft 29 of drum 12 is suitably supported for rotational movement, suitable drive means (not shown) being provided to turn drum 12 in the direction indicated by the solid line arrow as well as for initiating the cycle of operation of the various processing stations described heretofore. While the photoconductive surface of the xerographic machine 10 has been illustrated as a drum, it will be understood that other types of surface, such as a belt, may instead be used.

The developing instrumentalities of development station 18 are encased in a general developer housing 30. The lower or sump portion 31 of the developer housing 30 is adapted to be filled with a quantity of two component developer material. The developer may be raised to an elevated position for cascading down the photoconductive surface 28 by a series of buckets 32 on a movable belt 34 and guided for its motion by rollers 35. Power may be imparted to the rollers by any conventional power source, not shown, to move the buckets in the direction as indicated by the arrows.

As the buckets reach their uppermost position, they are adapted to release the developer through a throat-like opening, formed by the depending edge 30' of the developer housing 30 and internal guide plate 37, for guiding the developer onto the surface 28 of drum 12. Sump 31, buckets 32, and plate 37 extend a width approximately equal to the width of drum 12 to insure the cascading of developer across the entire width of the photoconductive surface 28. As the developer cascades down the arc of the drum, the latent electrostatic image therebelow on the drum surface 28 is developed. As the developer material falls past the horizontal center line of drum 12, the effect of gravity drops unused developer material onto the pick off baffle 39 and back into the sump 31 for recycling. A toner dispenser (not shown) may be provided with developer housing 30 for supplementing the toner given up by the system through development of images.

One or more developer assisting electrodes (not shown), which are subjected to a preset voltage bias, such as described in U.S. Pat. No. 3,667,036, issued May 30, 1972, may be provided. While a cascade type developing system has been illustrated, other developing systems, such as a magnetic brush system may be contemplated. In cases where a single or multiple magnetic brush developing system is used, the sleeve of the magnetic brush or brushes may be biased to a suitable valve to enhance development. One such arrangement is disclosed in copending U.S. application Ser. No. 439,196, filed Feb. 4, 1974, now U.S. Pat. No. 3,872,830.

In operation, the photoconductive surface 28 of drum 12 is normally charged to a predetermined positive level by corotron 15 following which the charged photoconductive surface is exposed at exposure station 16 to a light reflected image of the original being copied. Such exposure results in selective discharge of the photoconductive surface 28 in conformance with the image presented by the original on the photoconductive surface as described earlier. The photoconductive surface, bearing the latent elecrostatic image, is thereafter, developed at development station 18. The development material, which in the present example would use negative toner, is electrostatically attracted to and held on the photoconductive surface 28 by the positive charges thereon, the intensity of such charges being in accordance with and in proportion to the image outline. The developed image is thereafter transferred to web 21 following which the image on web 21 is fixed by fuser 26 to render the image permanent.

As alluded to earlier, corotron 15 functions to uniformly charge the photoconductive surface 28 of drum 12 preparatory to imaging. During use of xerograpic machines, such as the machine 10 schematically illustrated, the operating parameters change from time to time, due, in part, to aging of the components, operating conditions, cycle times, etc. Accommodation for these changes may often be made through adjustment of the charge level on drum 15. To avoid the need to manually adjust the output of corotron 15, automatic control, through the use of an electrometer 50, may be provided.

Electrometer 50 may comprise any suitable electrostatic voltage measuring apparatus such as a Model 501 Electrostatic Voltmeter manufactured by Monroe Electronics Corp. of Lyndonville, N.Y. As will be understood by those skilled in the art, electrometers of the type alluded to serve to measure the electrostatic charge on a surface, such as the photoconductive surface 28 of drum 12. This may be reflected in the form of a meter reading or as a control signal.

Electrometers of the type alluded to normally require a relatively complex and sophisticated probe designed for disposition adjacent the surface whose charge is to be measured, i.e., photoconductive surface 28 of drum 12. Probes of this type may incorporate apparatus to vibrate the probe and so produce a pulse-like signal output to the electrometer as the vibrating probe moves toward and away from the surface under measurement. Another type of probe incorporates a movable shutter designed to open and close the probe window at predetermined intervals and produce a pulse type signal output for use by the electrometer.

As will appear more fully herein, the electrode 68 of the present invention serves as the bias for producing the pulse-like output alluded to above. As a result, a relatively simple wire-like probe 52 may be provided with electrometer 50 instead.

Probe 52 is supported in closely spaced relationship with the photoconductive surface 28 of drum 12 adjacent one edge of drum 12 as will appear more fully. In the exemplary arrangement illustrated, probe 52 is disposed between corotron 15 and exposure station 16. However, other dispositions of probe 52 may be contemplated, i.e., between exposure station 16 and developer station 18.

The signal output of probe 52, the strength of which relates directly to the voltage level of the charged photoconductive surface 28 of drum 12 therebelow is inputted via line 53 to electrometer 50. There the incoming signal may be amplified as necessary to provide a usable signal for controlling the machine processing components, i.e. the voltage output of power supply 13 to corotron 15. In this manner, the charge level on the photoconductive surface 28 of drum 12 is varied in response to changes in the working charge level on drum 12.

It will be apreciated that the operating charge condition of the photoconductive surface 28 may be sampled at other locations as for example after exposure station 16. In this circumstance, the electrometer probe 52 would be supported in position opposite drum 12 downstream of exposure station 16.

While the power input to charge corotron 15 is illustrated as being controlled, the power input to other or additional processing components may be regulated, for example, the bias applied to one or more development electrodes, or the bias applied to the magnetic brush or brushes in the case where a magnetic brush type developing system is used instead of the cascade developing system illustrated etc.

Drum 12 comprises a metal substrate 63 having a coating or covering of photoconductive material, such as amorphous selenium on the exterior surface thereof. The drum substrate 63 is preferably grounded.

Figure 2:
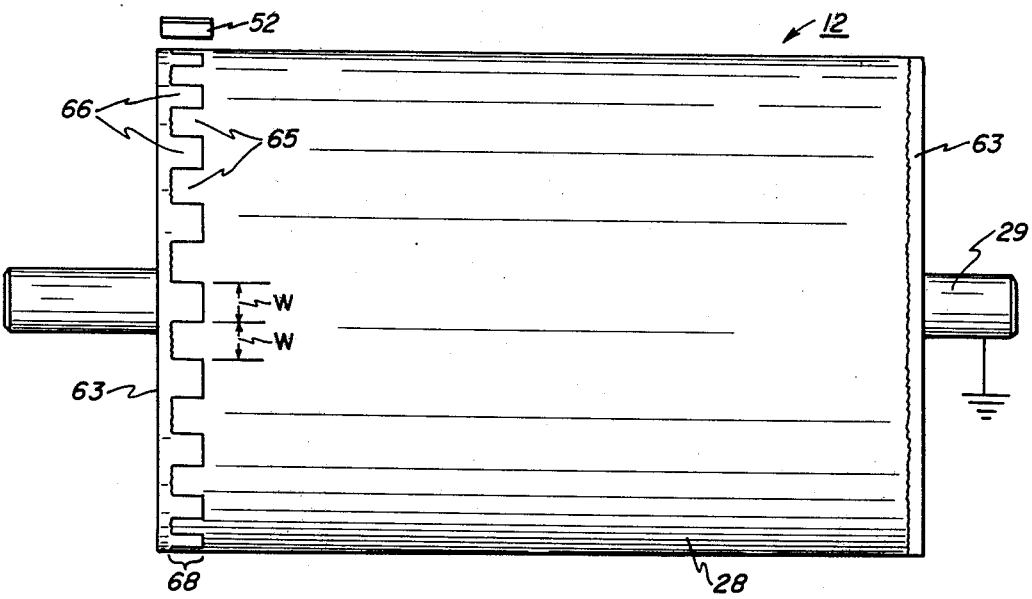
FIG. 2 is an enlarged schematic of a photoreceptor illustrating details of the built-in electrode of the present invention.
Figure 3:
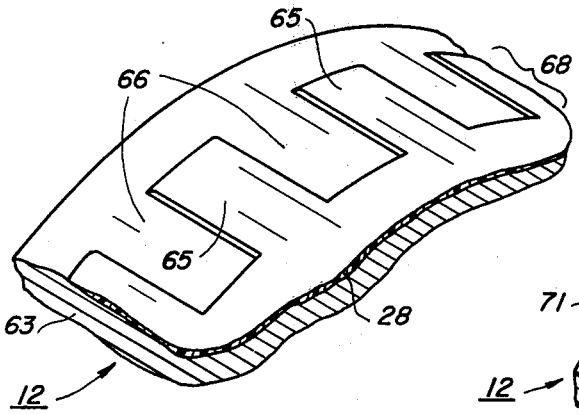
FIG. 3 is an enlarged partial isometric view of the photoreceptor electrode shown in FIG. 2.

Referring to FIGS. 2, 3 electrode 68 comprises a series of small bare or exposed strip-like portions 66 of substrate 63, preferably along one or the other of the drum edges, with coated strip-like portions 65 therebetween. The bare strips 66, may be formed by leaving these portions of the drum substrate 63 uncoated with the photoconductive material during manufacture of drum 12. As a result, there is formed a continuous ladder-like electrode extending around the circumference of drum 12.

While the width ($w$) of strips 65, 66 is illustrated as being substantially identical, the widths of the coated and uncoated strips 65, 66 respectively may be different so long as the width relationship between the strips 65, 66 remains constant.

In use, drum 12, bearing the ladder electrode 68 along one side, is disposed so that the electrode 68 is outside the normal operaing area of exposure, developing and transfer stations 16, 18, 20 respectively but within the area charged by corotron 15 and cleaned by lamp and brush 23, 24. Probe 52 of electrometer 50 is disposed in spaced relation to the photoconductive surface 28 of drum 12 and in alignment with the electrode 68 on drum 12.

During operation of copier 10, the photoconductive surface 28 of drum 12 including the coated strips 65 of electrode 68 are charged by corotron 15 as the photoconductive surface 28 moves therepast. The uncoated strips 66 remain at ground potential. As the charged and uncharged strips of electrode 68 pass under electrometer probe 52, probe 52 feeds a pulse-like signal output to electrometer 50 representative of the charge on the photoconductive surface 28 of drum 12.

As will be understood, the pulse-like output signal produced reflects two levels of voltage potential, the unknown voltage on the photoconductive surface 28 of drum 12 and the known potential of the uncoated or substrate portion 63 of drum 12. As described, substrate portion 63 may be at ground, or any present potential. The output signal produced accordingly reflects both the magnitude and polarity of the charge on the photoconductive surface 28 as compared to the known potential of electrode strips 66. In the exemplary arrangement described, this signal is processed by electrometer 50 and used to regulate power supply 13 of charge corotron 15 to provide the desired charge on the drum photoconductive surface.

Figure 4:
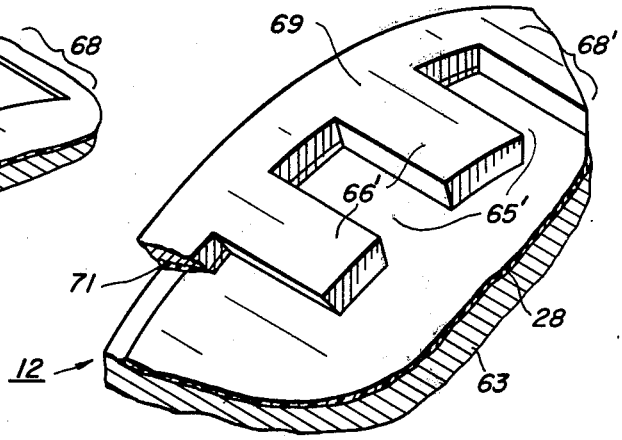
FIG. 4 is an enlarged partial isometric view of an alternate photoreceptor electrode construction.

While electrode 68 is illustrated as consisting of alternate coated and uncoated strips 65, 66 of drum 12, the electrode may instead comprise conductive elements disposed upon the surface of drum 12. Referring to FIG. 4, where like numerals refer to like parts, electrode 68' consists of a series of spaced finger-like conductors 66' and interconnecting conductive base 69 disposed over the photoconductive surface of drum 12, preferably along one edge thereof. In this arrangement, all or substantially all of the surface of drum 12 would be covered with a layer of photoconductive material with the result that strips 66' of electrode 68' cover portions of the photoconductive surface leaving other uncovered strip-like areas 65' of photoconductive surface therebetween.

Base 69 of electrode 68' is connected to a suitable reference potential such as ground or a suitable source of preset voltage. Where the reference potential is ground, base 69 of electrode 68' may comprise an uncoated edge portion of drum substrate 63. To obviate loss or dissipation of the reference potential where a preset voltage is applied to electrode 68', a suitable layer 71 of electrical insulating material may be provided between electrode 68' and the drum 12 thereunder.

To offset spacing sensitivity between probe 52 of electrometer 50 and the photoconductive surface 28 of drum 12, a feedback or nulling technique may be used employing electrode 68 or 68'. In that case, the reference potential applied to electrode 68 or 68' is adjusted until the pulse-like signal output of probe 52 is substantially zero. The reference potential, which is indicative of the charge on the photoconductive surface 28, may be measured as by a voltmeter. From this, one or more of the operating parameters of the machine 10, such as power supply 13 of corotron 15, may be adjusted until the desired electrode potential is obtained.

Alternately, a preset potential may be applied to electrode 68 or 68' and one or more of the machine operating parameters, i.e. power supply 13 of corotron 15, adjusted until the signal outpt of probe 52 is substantially zero. At this point, the potential of the drum photoconductive surface 28 and the preset potential applied to the electrode 68 or 68' are substantialy equal.

While the invention has been described with reference to the structure disclosed, it is not confined to the details set forth, but is intended to cover such modifications or changes as may come within the scope of the following claims.

What is claimed is:

1. A photoreceptor for use with electrostatic type reproduction machines, comprising:

a substrate; and a coating of photoconductive material on one surface of said substrate, portions of said photoconductive coated surface of said substrate being interrupted at regular intervals by conductive areas, said conductive areas extending in strip-like progression along said substrate one surface in the direction of movement of said photoreceptor whereby to provide a built-in strip-like control electrode with said photoreceptor.

2. The photoreceptor according to claim 1 in which said electrode is formed along one side by said photoreceptor.

3. The photoreceptor according to claim 1, in which said substrate is formed from a conductive material, said conductive areas comprising areas of said substrate one surface uncoated with said photoconductive material.

4. The photoreceptor according to claim 1, in which said conductive areas comprise a conductive material disposed over said coating of photoconductive material.

5. The photoreceptor according to claim 4, in which said conductive material includes a conductive element common to said conductive areas.

6. The photoreceptor according to claim 4 including means to electrically insulate said conductive material from said coating of photoconductive material.

7. In an electrostatic type reproduction apparatus having a movable photoreceptor on which electrostatic images are formed, with means for charging said photoreceptor in preparation for forming electrostatic images thereon; exposure means to selectively discharge said photoreceptor in accordance with an original being reproduced to thereby form an electrostatic image of the original; means to develop the latent electrostatic image; and control means for the charging means, said control means including a probe for scanning the photoreceptor, the improvement comprising:

a series of discrete electrodes integral with said photoreceptor and extending along the photoreceptor in the direction of photoreceptor movement for scanning by said probe, said electrode series including both base reference elecrodes adapted to bear a preset reference potential and photoreceptor electrodes adapted for charging with said photoreceptor by said charging means.

8. The reproduction apparatus according to claim 7, in which said base reference electrodes are at ground potential.

9. The reproduction apparatus according to claim 7, in which said electrode series is disposed adjacent one edge of said photoreceptor so as not to interfere with processing of images on said photoreceptor.

10. In an electrostatic reproduction machine having a movable photosensitive member, together with processing means for electrostatically creating and developing images of originals, sad processing means including charging means for placing an electrical charge on said member in preparation for creating an elecctrostatic latent image of an original, exposure means for exposing an original to create a latent electrostatic image thereof on said member, and developing means for developing said image, the combination of:

electrode means integral with said photosensitive member, said electrode means including a series of discrete strips extending along said photosensitive member in the direction of movement of said member, alternate ones of said strips being adapted to bear a preset reference charge while remaining ones of said strips comprising a photosensitive surface adapted to bear substantially the same charge as said photosensitive member; and a charge sensing element for scanning said photosensitive member electrode means to produce a signal reflecting the electrical charge on said photosensitive member.

* * * * *

UNITED STATES PATENT AND TRADEMARK OFFICE

CERTIFICATE OF CORRECTION

PATENT NO. : 4,000,944

DATED : January 4, 1977

INVENTOR(S) : Lawrence J. Fraser

It is certified that error appears in the above-identified patent and that said Letters Patent are hereby corrected as shown below:

Column 8, Claim 10, line 17, change "sad" to -- said --.

Signed and Sealed this

Twelfth Day of April 1977

[SEAL]

*Attest:*

RUTH C. MASON
*Attesting Officer*

C. MARSHALL DANN
*Commissioner of Patents and Trademarks*